US008646766B2

(12) United States Patent
Shrock

(10) Patent No.: US 8,646,766 B2
(45) Date of Patent: Feb. 11, 2014

(54) CLAMPING DEVICE

(75) Inventor: Joel Aaron Shrock, Berkeley, CA (US)

(73) Assignee: Shrockie LLC, Oakland, CA (US)

( * ) Notice: Subject to any disclaimer, the term of this patent is extended or adjusted under 35 U.S.C. 154(b) by 503 days.

(21) Appl. No.: 12/860,779

(22) Filed: Aug. 20, 2010

(65) Prior Publication Data

US 2011/0042878 A1 Feb. 24, 2011

Related U.S. Application Data

(60) Provisional application No. 61/235,920, filed on Aug. 21, 2009.

(51) Int. Cl.
*B25B 1/02* (2006.01)

(52) U.S. Cl.
USPC ..... 269/143; 269/3; 269/6; 269/249; 269/229; 269/231; 269/90

(58) Field of Classification Search
USPC ..... 269/3, 6, 143, 249, 229, 231, 90
See application file for complete search history.

(56) References Cited

U.S. PATENT DOCUMENTS

| | | | | | |
|---|---|---|---|---|---|
| 108,784 | A * | 11/1870 | Hildreth | 269/218 |
| 131,326 | A * | 9/1872 | Belcher | 269/5 |
| 378,893 | A * | 3/1888 | McIntyre | 269/158 |
| 509,310 | A * | 11/1893 | Heberling | 269/6 |
| 928,275 | A * | 7/1909 | Oakman | 269/229 |
| 1,162,059 | A * | 11/1915 | Hersey | 269/6 |
| 1,485,731 | A * | 3/1924 | Stangbye | 269/103 |
| 2,061,083 | A * | 11/1936 | Niemi | 294/116 |
| 2,118,729 | A * | 5/1938 | Hogan | 292/27 |
| 2,474,383 | A * | 6/1949 | Suhr | 43/37 |
| 2,491,373 | A * | 12/1949 | Goff | 280/508 |
| 2,584,881 | A * | 2/1952 | Johnson et al. | 294/19.3 |
| 2,591,636 | A * | 4/1952 | Thompson | 81/112 |
| 2,850,926 | A * | 9/1958 | Jobe | 269/234 |
| 5,209,530 | A * | 5/1993 | Kolloch | 292/27 |
| 5,430,914 | A * | 7/1995 | Patterson et al. | 24/598.5 |
| 5,606,782 | A * | 3/1997 | Patterson et al. | 24/598.5 |
| 5,746,464 | A * | 5/1998 | Paul | 294/116 |
| 5,832,651 | A * | 11/1998 | Arntz | 43/5 |
| 5,867,877 | A * | 2/1999 | Patterson et al. | 24/598.5 |
| 5,938,259 | A * | 8/1999 | Sawdon et al. | 294/116 |
| 6,598,896 | B1 * | 7/2003 | Hyslop | 280/414.1 |
| 6,696,650 | B2 * | 2/2004 | Muller et al. | 177/148 |
| 7,076,910 | B1 * | 7/2006 | Xifra | 43/4 |

* cited by examiner

*Primary Examiner* — Joshua J Michener
*Assistant Examiner* — Matthew Gitlin
(74) *Attorney, Agent, or Firm* — LeClairRyan, a Professional Corporation

(57) ABSTRACT

A clamping device includes a body having a first guiding feature and a slider component positioned within the body that is moveable between a first position and a second position. A pair of jaw members is coupled to a slider assembly, wherein the jaw members are moveable between a first state and a second state based on a direction of travel of the slider component. At least one of the jaw members includes a second guiding feature operably coupled to the first guiding feature of the body. The first and second guiding features cause the jaw members to automatically pivot from the first state to the second state when the slider component travels from the first position to the second position and pivot from the second state to the first state when the slider component travels from the second position to the first position.

18 Claims, 8 Drawing Sheets

CLAMPING DEVICE

STATEMENT OF RELATED APPLICATION

The present application claims the benefit of priority based on U.S. Provisional Patent Application Ser. No. 61/235,920, filed on Aug. 21, 2009, in the name of inventor Joel Aaron Shrock, entitled "Clamping Device", which is hereby incorporated by reference herein.

TECHNICAL FIELD

The present disclosure relates generally to a clamping device.

BACKGROUND

Many foods and other items are sold in packages made from polymer bags and it is desirable to reseal their original package to protect the unused contents without the need to transfer the contents to a new bag with a zipper type closer. Presently, some bags, such as those used on frozen corn or bread, are quite soft and are typically twisted closed by the user, and then a clamping device, such as a twist tie is used.

What is needed is a clamping device that will securely hold a bag or other external item closed in an improved manner.

Overview

In an aspect, a clamping device comprises a body having a first guiding feature therein. A slider component is positioned within the body and is moveable in a first direction and a second opposed direction in response to a user applied force. A jaw member is pivotably coupled to the slider component and actuatable between an open state and a closed state. The jaw member includes a second guiding feature operably coupled to the first guiding feature of the body, wherein the first and second guiding features cause the jaw member to automatically move from the open state to the closed state to secure an external item against the body when the slider component moves in the first direction. The first and second guiding features cause the jaw member to automatically move from the closed state to the open state when the slider component moves in the second direction.

In an aspect, a clamping device comprises a body having a first guiding feature and a slider component positioned within the body that is moveable between a first position and a second position. A pair of jaw members is coupled to the slider assembly, wherein the jaw members are moveable between a first state and a second state based on a direction of travel of the slider component. At least one of the jaw members includes a second guiding feature operably coupled to the first guiding feature of the body, wherein the first and second guiding features cause the jaw members to automatically pivot from the first state to the second state when the slider component travels from the first position to the second position and pivot from the second state to the first state when the slider component travels from the second position to the first position.

In an aspect, the jaw member forms an opening between the jaw member and the body to allow the external item to be placed in the opening when the jaw member is in the open state, wherein the jaw member secures the external item against the body and prevents removal of the external item from the clamping device when in the closed state.

In an aspect, the jaw member further comprises a first jaw member and a second jaw member, wherein the first and second jaw members rotate apart from one another with respect to the body when moving toward the open state and rotate toward one another with respect to the body by an adjacent guide when moving toward the closed state.

In an aspect, the clamping device includes a spring element coupled to the slider component at a first end and coupled to a wall at a second opposed end. The spring element compresses to a compressed state when the slider component moves in the first direction toward a closed position, wherein the spring element urges the slider component to move in the second direction toward an open position when in the compressed state.

In an aspect, the clamping device includes a locking system configured to maintain the slider component at one or more desired positions between the open and closed positions. The clamping device including a lock release configured to unlock the locking system, wherein the slider component automatically moves toward the open position when the lock release is operated to unlock the locking system. In an aspect, the locking system further comprises one or more indented engagement indentions in a first surface of the slider component; and a ratchet member integral to a first side of the body and loaded to be urged to come in contact with and engage the one or more engagement indentions to maintain the slider component at the one or more desired positions. The lock release further comprises a button on a second opposed side of the body, wherein depression of the button pushes the ratchet member away from the engagement indentions to release the slider component from the ratchet member.

In an aspect, an actuator member is coupled to the slider component and positioned at least partially outside the body, wherein a user applies a force to the actuator to cause the slider component to move in either the first or second direction.

In an aspect, the clamping device includes a magnet coupled to an outer surface of the body. In an aspect, the body of the clamping device is shaped to represent a fish.

In an aspect, the first guiding feature is a guide post which protrudes toward the jaw member in a direction perpendicular to a lengthwise plane of the body and the second guiding feature is a groove incorporated within the jaw member, wherein the guide post fits within the groove and moves along the groove when the slider component moves.

In an aspect, a clamping device comprises a body having a first guide post and a second guide post on an interior surface. A slider component is positioned within the body and is moveable between a closed position and an open position. A first jaw member is rotatably coupled to the slider component, in which the first jaw member has a first groove operably coupled to the first guide post. A second jaw member is rotatably coupled to the slider component, in which the second jaw member has a second groove operably coupled to the second guide post. The first and second jaw members are substantially exposed when outside the body. In this position, they are spaced apart from one another to allow an external item to be placed in between the first and second jaws when the slider component is at the open position. The first and second jaw members are substantially positioned within the body and relatively closer together to secure the external item between the first and second jaws and the body when the slider component is at the closed position. A spring element is coupled to the slider component and is configured to be in a compressed state when the slider component moves toward the closed position, wherein the spring element urges the slider component toward the open position when in the compressed state. A lock system is configured to maintain the slider component at one or more desired positions; and a lock release is configured to unlock the lock system, wherein the slider component automatically moves toward the open position when the lock release is operated.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the present invention; it being understood, however, that this invention is not limited to the precise arraignments shown. In the drawings, like reference numerals refer to like elements in several views.

In the drawings.

DETAILED DESCRIPTION

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
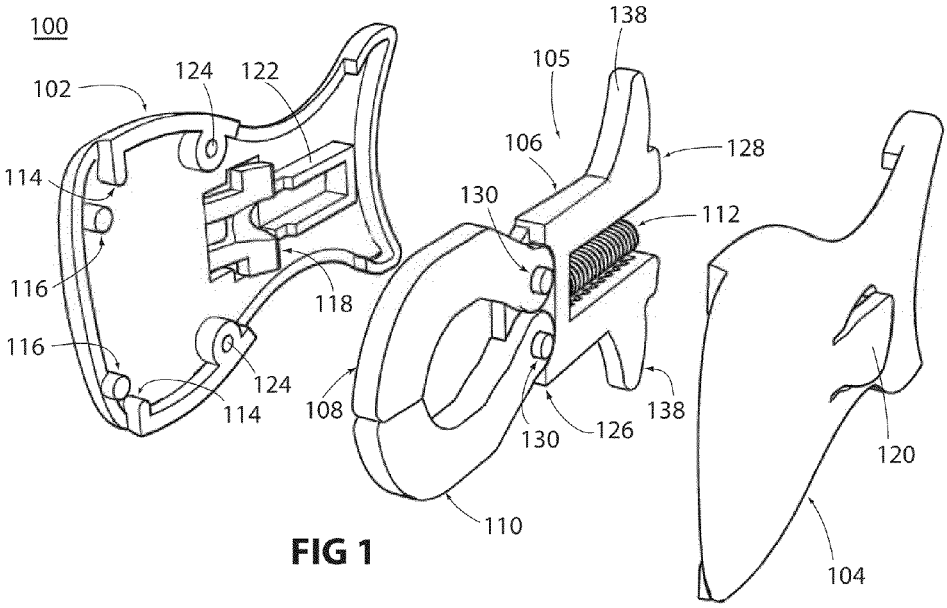
FIG. 1 illustrates an exploded view of the clamping device in accordance with an aspect of the present disclosure.
Figure 4:
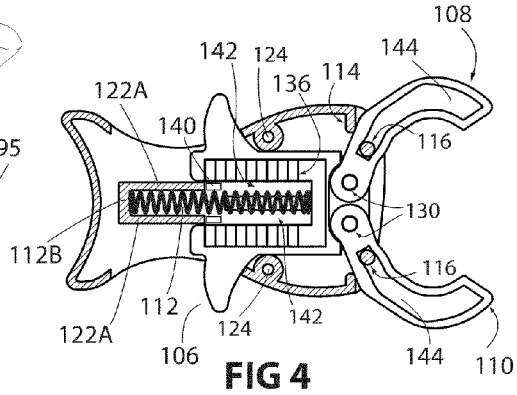
FIG. 4 illustrates an interior view of the clamping device in FIG. 3 in accordance with an aspect of the present disclosure.
Figure 6:
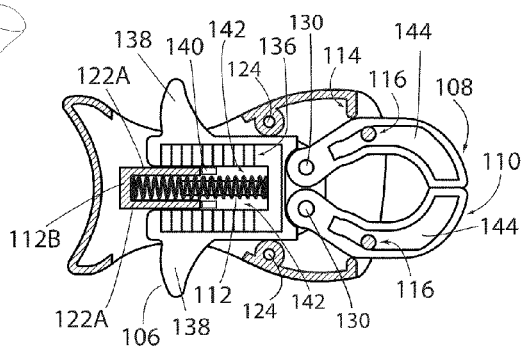
FIG. 6 illustrates an interior view of the clamping device in FIG. 5 in accordance with an aspect of the present disclosure.

FIG. 1 illustrates an exploded view of the clamping device in accordance with an aspect of the present disclosure. As shown in FIG. 1, the clamping device 100 includes a body which comprises two or more body pieces or components; and in particular a first body piece 102 and a second body piece 104. In an aspect, the first body piece 102 includes one or more guides 114 which extend from a periphery of the first body piece 102 inward toward the slider component 106, as shown in FIG. 1. Additionally or alternatively, the second body piece 104 includes one or more guides 114, as shown in FIG. 6, which cause of the jaws 108, 110 to move toward each other when the slider component 106 is moved toward the closed position. The guides 114 are optional, but may be incorporated as a limiting mechanism for jaws 108, 110 when they are in the open state (FIG. 4). It should be noted that the body components are shaped to represent a fish, although other designs and configurations are contemplated.

Figure 11:
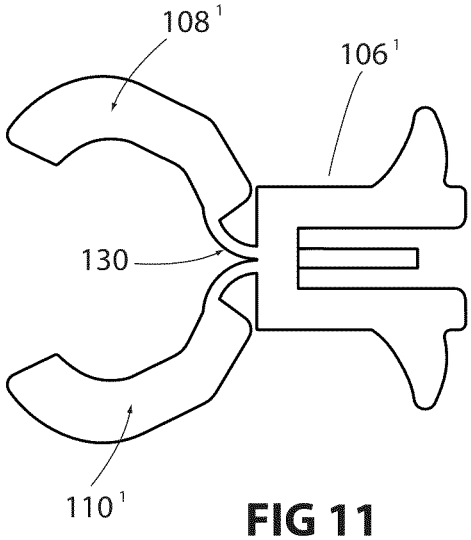
FIG. 11 illustrates an alternate slider component in accordance with an aspect of the present disclosure.

The first body piece 102 includes one or more guide posts 116 which extend perpendicular to the plane of the body piece 102. Additionally or alternatively, the second body piece 104 includes one or more guide posts 116 which extend perpendicular to the plane of the body piece 104. In an aspect, the guide posts 116 are stationary and fixed to the body piece, although it is contemplated that the guide posts 116 may be freely rotatable whereby the guide posts 116 rotate as the jaws are actuated. Alternatively, the slider component 106' incorporates one or more living hinges 130 that cause the jaws 108', 110' to open upon being moved to the open position by its tendency to spring back into the shape in which it was originally molded, as shown in FIG. 11. Alternatively, a leaf spring could also be used in place of the living hinge to connect the jaws and slider, as well as cause the jaws to open as they exit the body.

Figure 2:
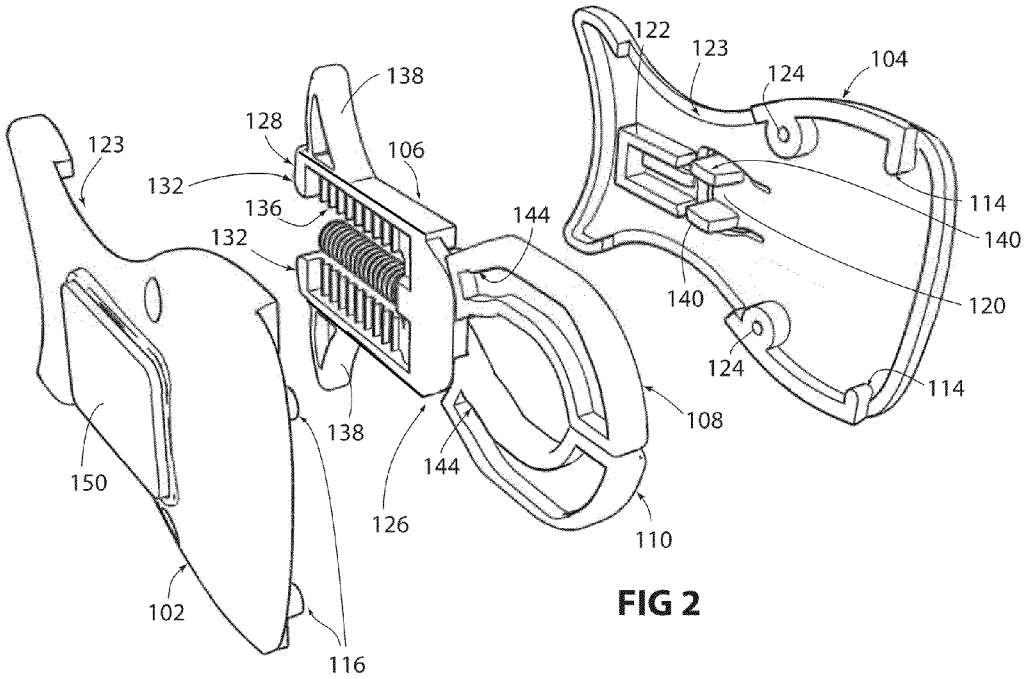
FIG. 2 illustrates an exploded view of the clamping device in accordance with an aspect of the present disclosure.

As shown in FIG. 2, an optional magnet 150 is mounted to either or both of the body components 102, 104 for removeably coupling the clamping device 100 to metal surfaces like a refrigerator door. In an embodiment, formation of the ratchet mechanism in the body component 102 may result in an aperture in the side of the body component 102, whereby the magnet 150 may be shaped and mounted to the body in a way to thereby cover the aperture.

In addition, the clamping device 100 includes an actuatable slider assembly 105 as shown in FIGS. 1 and 2. In particular, the slider assembly 105 includes a slider component 106 having a front end 126 and a back end 128. In addition, the slider component 106 includes one or more discreet legs 132 (FIG. 2) in which one or more of the legs includes a plurality of ratchet engagements 136 on either or both sides of the legs. It should be noted that the ratchet engagements 136 are optional.

As shown in FIG. 1, the first body piece 102 includes a locking mechanism 118 incorporated into the first body piece 102. Additionally, the second body piece 104 includes a lock release 120 incorporated into the second body piece 104 at a location where the lock release 120 cooperates with the locking mechanism 118. The first and/or second body pieces 102, 104 include one or more optional spring wells 122 defined by one or more walls. The first and second body pieces 102, 104 include one or more optional screw bosses 124 which holds the two body pieces 102, 104 together and may also function as guides for the slider component 106 during actuation.

In an aspect, each leg 132 includes one or more actuators or flanges 138 extending outward from the side of the component 106 along its plane. The flanges 138 allow the user to actuate the slider assembly between an open position and a closed position, as discussed in more detail below. In an aspect, the actuators 138 are simply a surface, or multitude of surfaces that create an implied surface, that face in a direction that is generally in the opposite direction as the intended direction of motion of the slider component, although this is not necessary. In the example shown in the drawings, the actuators 138 are in the same plane as the slider component 106. However, it is noted that they are not limited to this orientation, as they can be positioned perpendicularly or on an angle to the slider component 106. The actuators 138 are exposed and outside of the body 102 and extend through openings, or slots 123, in the body. It should be noted that the particular configuration of the flanges 138 shown in the figures is not limiting and other mechanisms may be used which allow the user to move or actuate the slider assembly 105 between the open position and the closed position.

Figure 10:
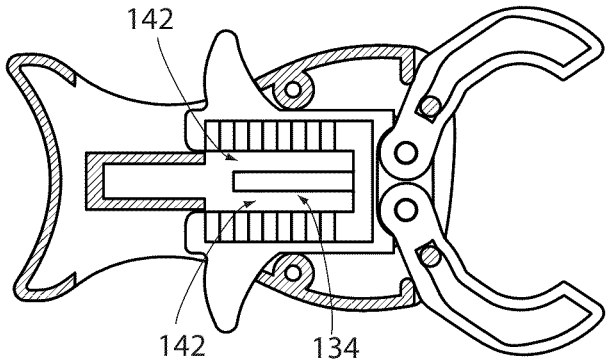
FIG. 10 illustrates an interior view of the clamping device with the spring element removed in accordance with an aspect of the present disclosure.

In an aspect, the slider component 106 includes one or more shafts 134 which holds a spring element 112. In one example, the slider component 106 utilizes a single central shaft 134 (FIG. 10) positioned between the legs 132 in which the shaft 134 is configured to fit within an interior of a coil spring element 112, as shown in FIGS. 1 and 2. In an aspect, the spring element 112 is configured to be compressive, although an extension spring may be alternatively used. In an aspect, the spring element 112 has a diameter to provide adequate spacing 142 (FIGS. 4, 6 and 8) between the spring element 112 and the adjacent leg 132 to allow the side walls 122A of the spring well 122 to pass therethrough as the slider assembly 105 moves between the open and closed positions. In an aspect, the spacings 142 allow the prongs 140 of the release mechanism 120 to come into contact with the locking mechanism 118, as will be discussed in more detail below.

In an aspect, the slider assembly 106 includes a pair of jaw posts 130 at the front end as well as a pair of pivotable jaws 108, 110 which are coupled to the jaw posts 130, whereby the jaws are freely rotatable about the posts 130. In an aspect, the one or more jaws includes a groove 144 in one or more sides which receives a corresponding guide post 116 therein. It is alternatively contemplated that one or more jaws may be configured to house the guide post 116 whereby the corresponding groove 144 is incorporated in the body of the device.

Figure 7:
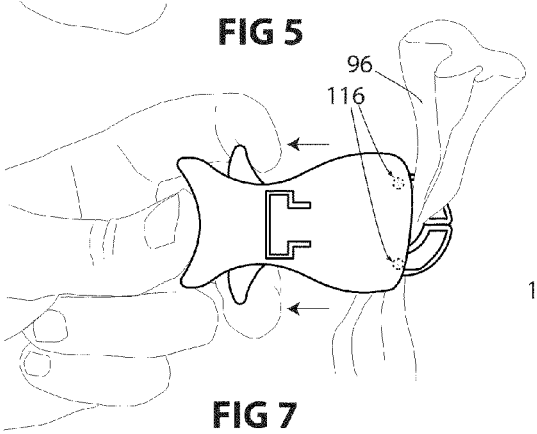
FIG. 7 illustrates an exterior view of the clamping device in operation and in a closed state in accordance with an aspect of the present disclosure.
Figure 8:
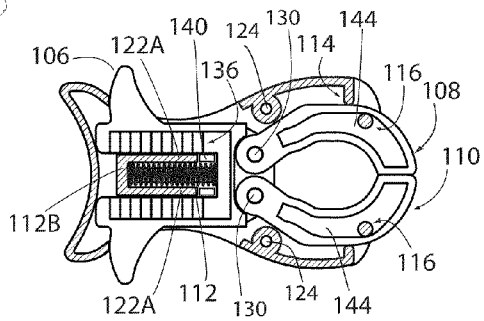
FIG. 8 illustrates an interior view of the clamping device in FIG. 7 in accordance with an aspect of the present disclosure.

The slider assembly 105 is positioned between the two body components 102 and 104, whereby the body components 102, 104 are coupled to one another to form the overall clamping device 100. The slider assembly 105 is designed to slidably move within the body between an open position (FIGS. 3 and 4) and a closed position (FIGS. 7 and 8). In the open position, the spring element 112 is uncompressed in comparison to when in the closed position in FIGS. 7 and 8, although the spring element 112 may be configured to apply some force when the slider assembly is in the open position. As shown in FIG. 4, the spring element 112 is positioned between a wall 122B of the spring well 122 and the slider component 106, whereby the spring element 112 urges the slider component 106 to move away from the wall 122B of the spring well 122 and urge the slider component 106 toward the open position.

Figure 3:
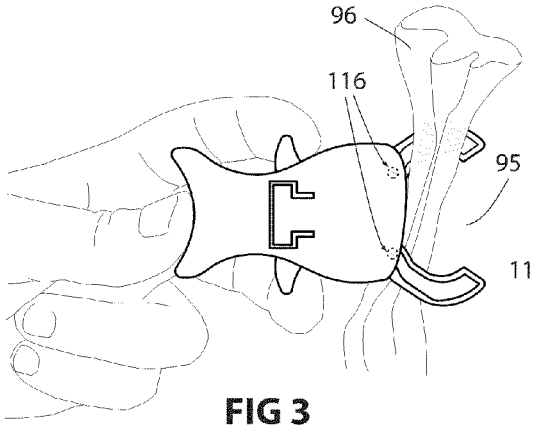
FIG. 3 illustrates an exterior view of the clamping device in operation and in an open state in accordance with an aspect of the present disclosure.

As shown in FIGS. 3 and 4, when in the open position, the jaws 108, 110 are in the open state such that they are positioned away from each other vertically and horizontally spaced away from the body to provide an opening 95 to allow a bag or other external item 96 to be positioned between the jaws 108, 110. As stated, the jaws 108, 110 are coupled to the slider component 106 and are pivotable about the jaw posts 130. As mentioned above, one or more of the jaws 108, 110 includes a groove 144 which receives a corresponding guide post 116 from either or both the body components 102.

Figure 5:
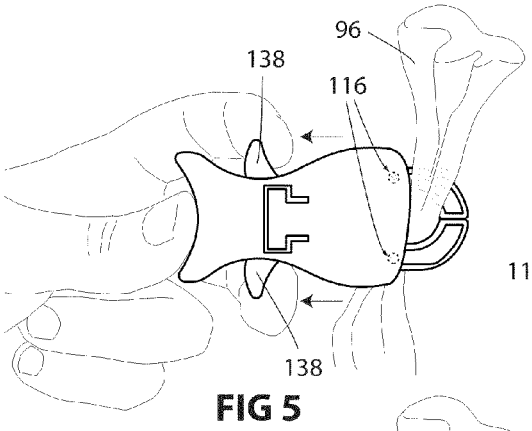
FIG. 5 illustrates an exterior view of the clamping device in operation and in an intermediate state in accordance with an aspect of the present disclosure.

During operation, as shown in FIG. 3, the user grips the clamping device 100, preferably with one hand, whereby the user's index and middle fingers are in contact with the flanges 136 while the user's thumb is in contact with the rear surface of the clamping device to provide an opposing force. One significant advantage of the clamping device 100 is the ability for the user to actuate the device with only one hand, as shown in FIGS. 3, 5 and 7. As will be shown, one or more of the guide posts 116 effectively run along the groove 144 of the jaw as the slider component moves between the open and closed positions, thereby causing the jaws 108, 110 to move in a predetermined manner based on the shape of the groove 144. As stated above, the guides 114 causes the jaws 108, 110 to move toward each other as the slider component 106 is moved toward the closed position. As can be seen in the example in FIGS. 4, 6, and 8, the walls 122A of the spring well 122 move along the spaces 142 of the slider assembly 105 while the screw bosses 124 stay in contact with the outer surfaces of the legs to effectively guide the slider assembly 106 while it is being actuated.

Referring now to the example in FIGS. 5 and 6, the user applies a force to the flanged actuators 138 using his or her index and middle fingers, as indicated by the arrows, while the thumb provides an opposing force to cause the flanged actuators 138 to move toward the rear of the device. In particular, the opposing forces between the user's index and middle fingers and the thumb provide the necessary force to overcome the force applied by the spring element 112 to the slider component 106. The user applied force causes the slider component 106 to move linearly toward the back end of the clamping device 100, preferably along a series of intermediate positions. Considering that the jaws 108, 110 are coupled to the slider component 106, the jaws 108, 110 move along with the slider component 106. However, the guides 114 and/or the guide posts causes the jaws 108, 110 to automatically move toward each other while moving toward the back of the body in a pivoting manner as the slider component 106 is moved toward the rear of the device 100. Again, this change in horizontal and vertical direction in a pivoting manner is due to the grooves of the jaws 108, 110 being guided by the stationary guide posts 116 as the slider component 106 is moved and the guides 114 pressing along the outer surfaces of the jaws 108, 110. As can be seen in FIG. 5, the movement of the jaws 108, 110 toward each other as well as toward the body of the clamping device 100 effectively decreases the size of the opening 95 in which the external item 96 is located, such that the jaws 108, 110 close in around the external item 96.

As shown in FIGS. 7 and 8, the user presses the flanged actuators 138 to a point in which the jaws 108, 110 can no longer move into the body due to the presence of the external item 96 or the full closure of the device (e.g. the slider component 106 reaching the closed position). At this point, the clamping device 100 is in the closed position in which the first and second jaw are in contact with one another, or nearly in contact, and are pulled as far as possible inside the body.

When in the closed state, the jaws 108, 110 apply a sufficient force to the external item 96 to hold and secure a item 96 within the opening 95 of the clamping device. The resulting force between the jaws and the body effectively maintains closure of the bag. It should be noted that the amount of travel of the slider assembly depends on the size of the external item 96 within the opening 95. In other words, a smaller item 96 will allow the jaws 108, 110 to close further inside the body as opposed to a larger item 96. Therefore, the amount of force applied to the external item 96 in securing it to clamping device 100 is directly proportional to distance which the user is able to move the slider assembly 106. In other words, the gripping force of the clamping device 100 on the external item 96 is a function on the user's applied force as opposed to the force applied by the spring element or other component within the clamping device. This is the preferred configuration as the user can generate more force onto the external item than a typical spring loaded clamping device.

As stated above, the clamping device 100 includes a locking mechanism which effectively locks the slider assembly at one or more user designated positions, such as the closed position, the open position and/or one or more intermediate positions between the open and closed positions. In an aspect, the clamping device 100 also includes a lock release which unlocks the locking mechanism when operated by the user. In particular to the example shown herein, the locking mechanism comprises a ratchet-based system having a spring loaded ratchet 118 incorporated into a side of the body 102, wherein the ratchet 118 has a beveled tab which faces the engagement indentions 136 of the slider component 106. As shown in FIG. 2, the release mechanism is in the form of a depressible button 120 on a side of the second body component 104, whereby the button 120 includes one or more release tabs 140 which faces the ratchet 118 and moves actuates the ratchet 118 away from the engagement indentions 136, thereby unlocking the slider component 106, when the button 120 is operated.

Figure 9A:
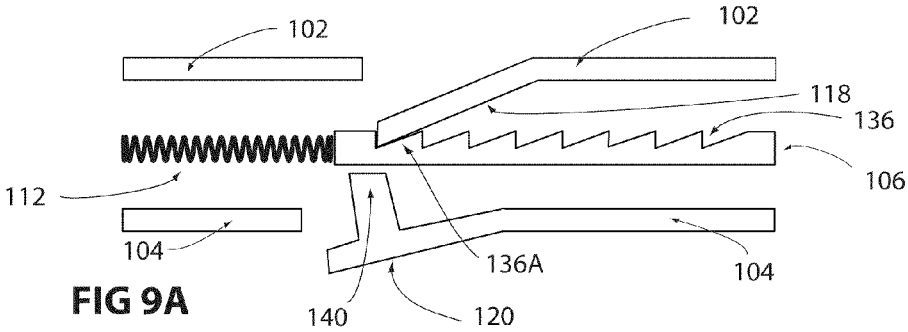
FIGS. 9A-9D illustrate cross sectional views of a locking mechanism and corresponding release mechanism in operation in accordance with an aspect of the present disclosure.
Figure 9B:
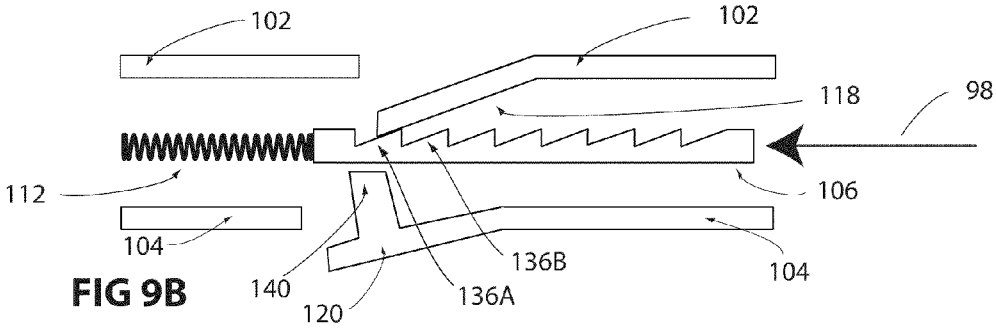
Figure 9C:
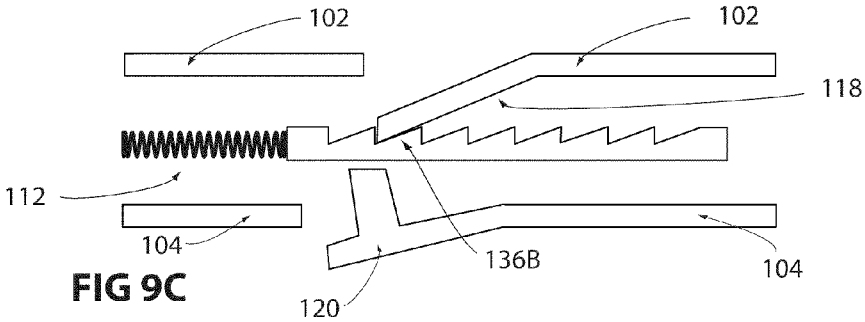

FIGS. 9A-9D illustrate cross sectional views of a locking mechanism and corresponding release mechanism in operation in accordance with an aspect of the present disclosure. As shown in FIGS. 9A-9C, the slider component includes a plurality of engagement indentions 136, however any number of indentions 136, including one, is contemplated. It is also contemplated that although the engagement indentions 136 are shown in FIGS. 9A-9C to have a sawtoothed cross sectional shape, other polygonal and non-polygonal cross sectional shapes are contemplated.

As shown in the cross-sectional view in FIG. 9A, the slider component 106 is in a locked position, whereby the beveled tab of the ratchet 118 is shown engaged with a particular engagement indention 136A. As shown in FIG. 9A, the engagement between the ratchet 118 and the engagement indention 136 prevents the slider component 106 from moving toward the open position.

As shown in FIG. 9B, a force applied to the slider component 106 by the user causes the slider component 106 to move in the direction of the arrow 98, whereby the sawtooth configuration of the engagement indentions 136 causes the tab of the ratchet 118 to automatically disengage from the previous indention 136A. As the adjacent engagement indention 136B moves just below the tab of the ratchet 118, as shown in FIG. 9C, the spring loaded characteristic of the ratchet 118 causes it to automatically engage the indention 136B, thereby locking the slider component 106 at that position.

Figure 9D:
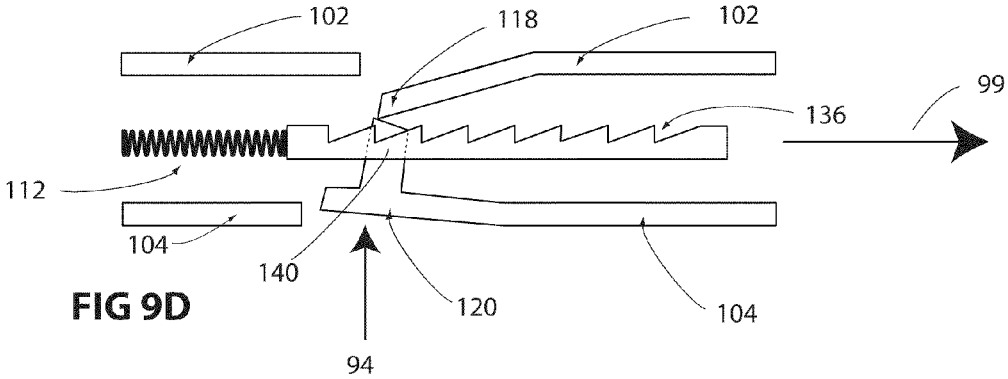

As shown in FIG. 9D, the release mechanism, in the form of button 120, moves upward toward the tab of the ratchet 118, as shown by arrow 94, whereby one or more release tabs 140 presses up against the ratchet 118 and causes it to move upwards and away from the indention 136B. Once the ratchet 118 disengages the indentation 136B, the opposing force terminates and the spring element 112 causes the slider component 106 to automatically move toward its open position, as shown by the arrow 99 in FIG. 9D.

Although the locking mechanism and the release mechanism are shown on the sides of the body, they may be located elsewhere on the clamping device 100. It should be noted that although a specific type of locking mechanism and release mechanism is described above, it is contemplated that the clamping device may utilize various other appropriate types of locking mechanisms and corresponding release mechanisms to prevent the jaws from opening. It is also contemplated that the clamping device does not use a locking mechanism and release mechanism, thereby rendering them optional.

Figure 12A:
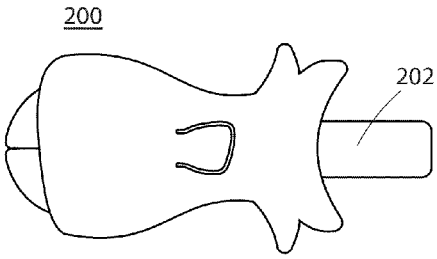
FIGS. 12A-12C illustrate an alternative clamping device in accordance with an aspect of the present disclosure.
Figure 12B:
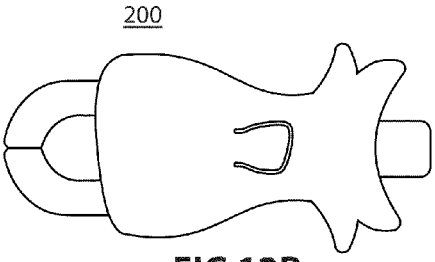
Figure 12C:
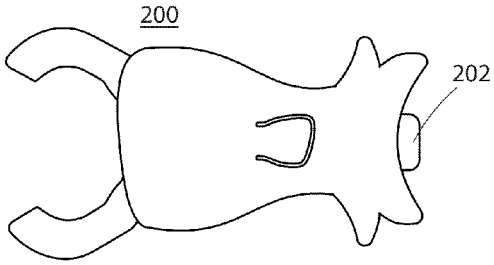

FIGS. 12A-12C illustrate an alternative clamping device in accordance with an aspect of the present disclosure. As shown in FIGS. 12A-12C, the clamping device 200 does not include the actuators 138, but instead includes an slidable actuator 202 which extends out the rear of the clamping device 200, whereby the clamping device 200 is operated in the same manner as that described above when the user pulls on the actuator flange 202.

Figure 13A:
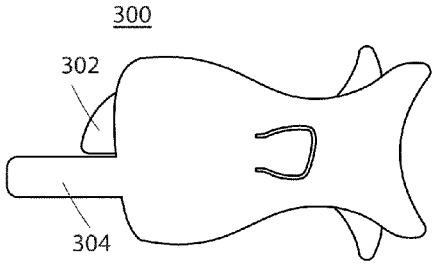
FIGS. 13A-13C illustrate an alternative clamping device in accordance with an aspect of the present disclosure.
Figure 13B:
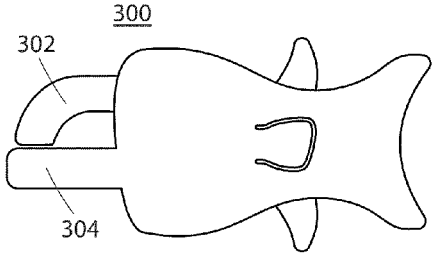
Figure 13C:
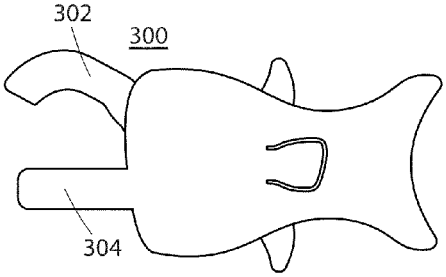

FIGS. 13A-13C illustrate an alternative clamping device in accordance with an aspect of the present disclosure. As shown in FIGS. 13A-13C, the clamping device 300 includes a jaw 302 which pivots while moving horizontally and vertically with respect a stationary jaw 304 when the slider component is actuated.

Figure 14A:
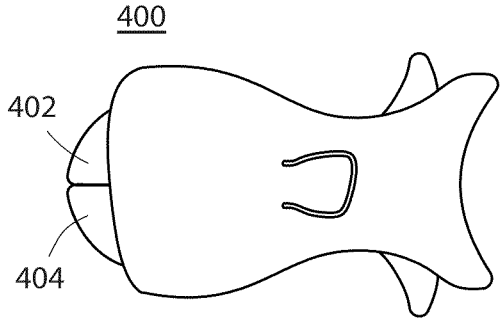
FIGS. 14A-14C illustrate an alternative clamping device in accordance with an aspect of the present disclosure.
Figure 14B:
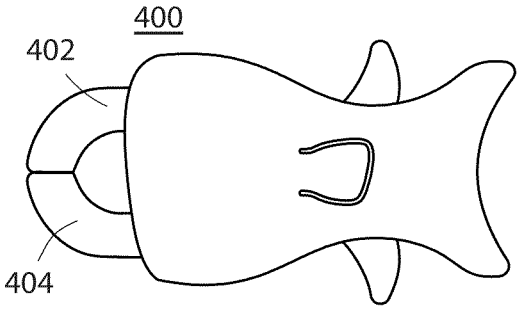
Figure 14C:
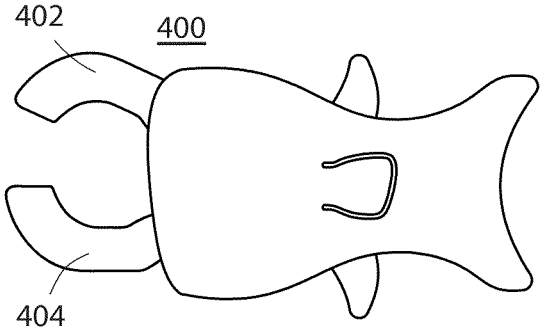

FIGS. 14A-14C illustrate an alternative clamping device in accordance with an aspect of the present disclosure. As shown in FIGS. 14A-14C, the clamp device 400 is configured such that it has one pivoting jaw 402 whereas the other jaw 404 slides horizontally outward, but does not pivot. The jaws could also be a single unitary member with a mechanical hinge or living hinge connecting the ends of the jaws.

Figure 15A:
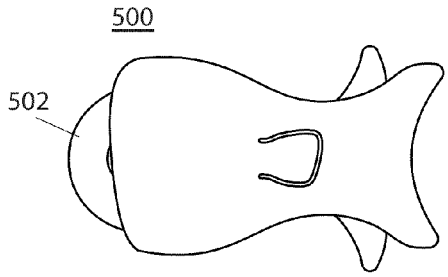
FIGS. 15A-15F illustrate alternative clamping devices in accordance with an aspect of the present disclosure.
Figure 15D:
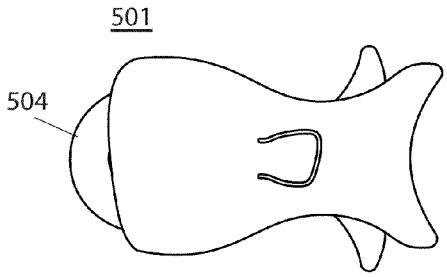
Figure 15B:
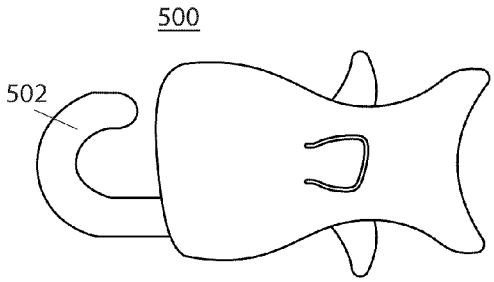
Figure 15E:
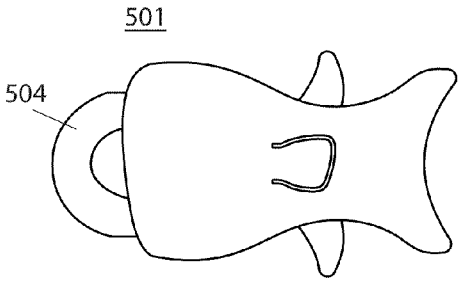
Figure 15C:
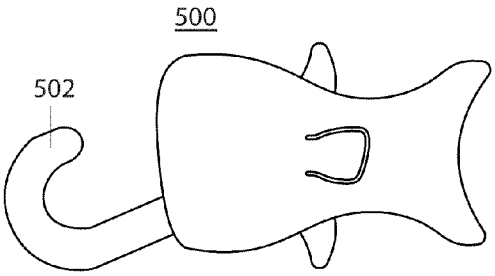

FIGS. 15A-15C illustrate an alternative clamping device in accordance with an aspect of the present disclosure. As shown in FIGS. 15A-15C, the clamping device 500 includes a single jaw 502 which pivots as well as moves horizontally and vertically when the slider component is actuated. It is contemplated that the jaw 502 be configured to move only vertically or horizontally when the slider component is actuated.

Figure 15F:
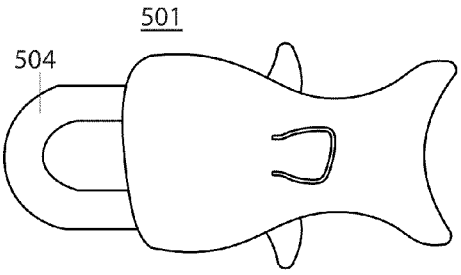

FIGS. 15D-15F illustrate an alternative clamping device in accordance with an aspect of the present disclosure. As shown in FIGS. 15D-15F, the clamping device 501 includes a single jaw 504 which moves horizontally along with the slider component as it is actuated.

In any of the above implementations, it is contemplated that the clamping device be implemented in a reverse configuration, whereby the slider assembly is urged toward the closed position by the spring element. In this case, the user would hold the clamp in the same manner, but when the user presses an actuator tab 202 that extends out from the rear of the device (FIGS. 12A-12C), the force from the hand of the user would overcome the spring and cause the jaws to slide out of the body and apart from one another to the open position, as described above. When the user releases the pressure on the slider assembly, the jaws would rotate closed, then retract into the body by way of the spring that directs the jaws into the closed position. Additionally, any of the above embodiments could benefit from the addition of an aperture in the clamp device to allow it to be hung from items in the house, such as a coat hook or the like.

Figure 16A:
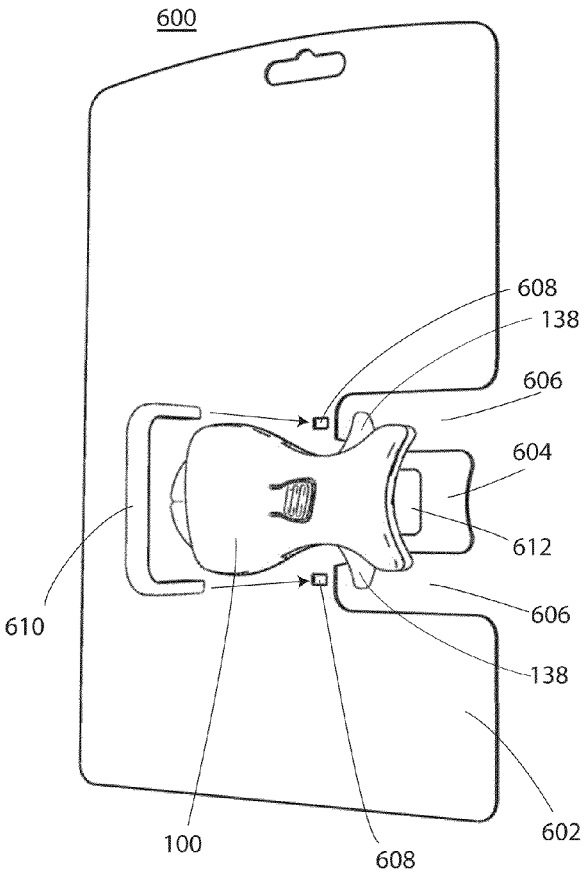
FIGS. 16A-16B illustrate a package for a clamping device in accordance with an aspect of the present disclosure.
Figure 16B:
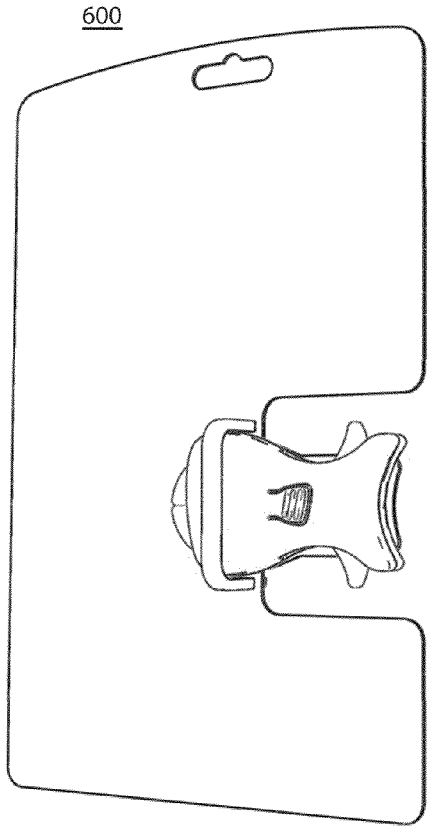

FIGS. 16A and 16B illustrate a package for a clamping device in accordance with an aspect of the present disclosure. As shown in FIGS. 16A and 16B, the package 600 has a substantially flat planar configuration in which the package 600 includes a face 602 which receives one or more clamping devices 100 whereby the one or more clamping device 100 are fixed to the face 602 of the package 600. An optional set of bracket apertures 608 in the package 600 allow a bracket 610 or other securing means to secure the clamping device 100 to the package 600.

It should be noted that although only one clamping device 100 is shown in the figures, the package 600 may be designed to hold more than one clamping device 100 thereon. As shown, the package 600 includes one or more notched portions 604 with one or more spaces 606 adjacent to either or both sides of the notched portion 604. As shown in the Figures, the notched portion 604 has a length and width dimensions which allow the clamping device 100 to be positioned on the notched portion 604. The spaces 606 are devoid of package material and serve as locations where the user can place their fingers around the flanges 138 to operate the clamping device 100. It is preferred that the clamping device 100 is positioned on the notched portion 604 such that the user is able to place his or her thumb on the rear portion of the clamping device 100. This configuration of the package 600 thereby allows the user to "try" or demo the clamping device 100 while the clamping device 100 is still attached to the package (such as while the package 600 is still on display at the store). An optional magnet space 612 may be formed in the notched portion 604 to allow the magnet 150 to be seated through the package and provide a flush mounting between the clamping device 100 and the package 600.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A clamping device comprising:

a body having a first guiding feature therein;

a slider component positioned within the body and moveable linearly in a first direction and a second opposed direction in response to a user applied force;

a jaw member coupled to the slider component and pivotably and linearly actuatable between an open state and a closed state, the jaw member configured to receive an external item in an opening having an area defined by the jaw member, the jaw member including a second guiding feature operably coupled to the first guiding feature of the body, wherein the first and second guiding features are configured to cause the jaw member to automatically pivot and linearly move with the slider component while simultaneously decreasing the area of the opening to forcibly secure the external item against the body when the slider component moves in the first direction toward the closed state a spring element coupled to the slider component at a first end and coupled to a wall at a second opposed end, wherein the spring element compresses to a compressed state when the slider component moves in the first direction toward a closed position, and wherein the spring element urges the slider component to move in the second direction toward an open position when in the compressed state.

2. The clamping device of claim 1, wherein the jaw member forms an opening between the jaw member and the body to allow an external item to be placed in the opening when the jaw member is in the open state, wherein the jaw member secures the external item against the body and prevents removal of the external item from the clamping device when in the closed state.

3. The clamping device of claim 1, wherein the jaw member further comprises a first jaw member and a second jaw member, wherein the first and second jaw members rotate apart from one another with respect to the body when moving toward the open state and rotate toward one another with respect to the body when moving toward the closed state.

4. The clamping device of claim 1, further comprising:

a locking system configured to maintain the slider component at one or more desired positions between the open and closed positions; and a lock release configured to unlock the locking system, wherein the slider component automatically moves toward the open position when the lock release is operated to unlock the locking system.

5. The clamping device of claim 4, wherein the locking system further comprises:

one or more indented engagement indentions in a first surface of the slider component; and a ratchet member integral to a first side of the body and loaded to be urged to come in contact with and engage the one or more engagement indentions to maintain the slider component at the one or more desired positions, and wherein the lock release further comprises:

a button on a second opposed side of the body, wherein depression of the button pushes the ratchet member away from the engagement indentions to release the slider component from the ratchet member.

6. The clamping device of claim 1, further comprising an actuator member coupled to the slider component and positioned at least partially outside the body, wherein a user applies a force to the actuator to cause the slider component to move in either the first or second direction.

7. The clamping device of claim 1, further comprising a magnet coupled to an outer surface of the body.

8. The clamping device of claim 1, wherein the body is shaped to represent a fish.

9. The clamping device of claim 1, wherein the first guiding feature is a guide post which protrudes toward the jaw member in a direction perpendicular to a lengthwise plane of the body and the second guiding feature is a groove incorporated within the jaw member, wherein the guide post fits within the groove and moves along the groove when the slider component moves.

10. A clamping device comprising:

a body having a first guiding feature;

a slider component positioned within the body and linearly moveable between a first position and a second position;

a pair of jaw members coupled to the slider assembly, the jaw members configured to receive an external item in an opening area defined between the jaw members, wherein the jaw members are moveable between a first state and a second state based on a direction of travel of the slider component, at least a first jaw member including a second guiding feature operably coupled to the first guiding feature of the body, wherein the first and second guiding features cause at least the first jaw member to automatically pivot toward a second jaw member and linearly move toward the body to decrease the opening area and apply a clamping force to the external item as the slider component linearly travels from the first position to the second position a spring element coupled to the slider component at a first end and coupled to a wall at a second opposed end, wherein the spring element compresses to a compressed state when the slider component moves in the first direction toward a closed position, and wherein the spring element urges the slider component to move in the second direction toward an open position when in the compressed state.

11. The clamping device of claim 10, wherein the jaw member forms an opening between the jaw member and the body to allow an external item to be placed in the opening when the jaw member is in an open state, wherein the jaw member secures the external item against the body and prevents removal of the external item from the clamping device when in a closed state.

12. The clamping device of claim 10, wherein the jaw members are vertically and horizontally spaced apart from one another with respect to the body when in an open state and are vertically and horizontally spaced close together with respect to the body when in a closed state.

13. The clamping device of claim 10, further comprising:

a lock system configured to maintain the slider component at one or more desired positions between the open and closed positions; and a lock release configured to unlock the lock system, wherein the slider component automatically moves toward the open position when the lock release is operated to unlock the lock system.

14. The clamping device of claim 10, further comprising an actuator flange coupled to the slider component and positioned at least partially outside the body, wherein the slider component moves in the first direction in response to a user applied force to the actuator flange.

15. The clamping device of claim 10, further comprising a magnet coupled to an outer surface of the body.

16. The clamping device of claim 10, wherein the body is shaped to represent a fish.

17. The clamping device of claim 10, wherein the first guiding feature is a guide post which protrudes toward the jaw member in a direction perpendicular to a lengthwise plane of the body and the second guiding feature is a groove incorporated within the jaw member, wherein the guide post fits within the groove and moves along the groove when the slider component moves.

18. A clamping device comprising:

a body having a first guide post and a second guide post on an interior surface;

a slider component positioned within the body and linearly moveable between a closed position and an open position;

a first jaw member rotatably coupled to the slider component, the first jaw member having a first groove operably coupled to the first guide post;

a second jaw member rotatably coupled to the slider component, the second jaw member having a second groove operably coupled to the second guide post, wherein the first and second jaw members are spaced apart from one another to allow an external item to be inserted in an opening area defined between the first and second jaws when the slider component is at the open position, and wherein the first and second jaw members are configured to simultaneously pivot toward one another and linearly move toward the body to decrease the opening area and forcibly secure the external item between the first and second jaws and the body when the slider component is at the closed position;

a spring element coupled to the slider component configured to be in a compressed state when the slider component moves toward the closed position, wherein the spring element urges the slider component toward the open position when in the compressed state;

a lock system configured to maintain the slider component at one or more desired positions; and a lock release configured to unlock the lock system, wherein the slider component automatically moves toward the open position when the lock release is operated.

* * * * *